US005129560A

United States Patent [19]

Herman

[11] Patent Number: 5,129,560

[45] Date of Patent: Jul. 14, 1992

[54] UTILITY BAG SYSTEM

[76] Inventor: Stephanie Herman, 4 W. 90th St., New York, N.Y. 10024

[21] Appl. No.: 741,965

[22] Filed: Aug. 5, 1991

Related U.S. Application Data

[63] Continuation of Ser. No. 407,864, Sep. 15, 1989, abandoned.

[51] Int. Cl.[5] ..... A45F 4/00

[52] U.S. Cl. ..... 224/151; 224/204; 224/205; 224/208; 224/153

[58] Field of Search ..... 224/151, 153, 202, 204, 224/206, 205, 208; 150/111, 109

[56] References Cited

U.S. PATENT DOCUMENTS

| | | | |
|---|---|---|---|
| D. 312,726 | 12/1990 | Kline | 224/215 |
| 1,601,624 | 9/1926 | Houghton . | |
| 1,797,359 | 3/1931 | Meyers | 224/205 |
| 1,884,328 | 10/1932 | Sperling | 224/206 |
| 3,537,628 | 11/1970 | Thompson | 224/205 |
| 3,739,961 | 6/1973 | Soukeras | 224/205 |
| 3,796,357 | 3/1974 | Johnson | 224/206 |
| 3,848,267 | 11/1974 | De Spain | 224/151 |
| 3,910,470 | 10/1975 | Swenson . | |
| 4,125,212 | 11/1978 | Courchesne . | |
| 4,424,841 | 1/1984 | Smith | 224/151 |
| 4,878,606 | 11/1989 | Miller | 224/208 |

FOREIGN PATENT DOCUMENTS

| | | | |
|---|---|---|---|
| 2589339 | 5/1987 | Fed. Rep. of Germany | 224/202 |
| 59712 | 12/1937 | Norway | 224/208 |
| 230388 | 12/1943 | Switzerland | 224/153 |

*Primary Examiner*—Linda J. Sholl

*Attorney, Agent, or Firm*—Cohen, Pontani, Lieberman & Pavane

[57] ABSTRACT

A utility bag system (10) to be worn on the person (74) comprises first (12) and second (14) bags, a strap (20) to be worn about the neck, shoulders or waist and joining the tops of the bags (12, 14), a waist belt (34), and loops (30, 32) secured to the back of the bags (12, 14) for receiving the belt (34) for holding the utility bag system (10) adjacent the body.

6 Claims, 6 Drawing Sheets

UTILITY BAG SYSTEM

This is a continuation of U.S. application Ser. No. 07/407,864, filed Sep. 15, 1989 now abandoned.

BACKGROUND OF THE INVENTION

1. Field of the Invention

This invention pertains to bags worn on the person for carrying various articles.

2. Prior Art

Women, and more recently men, are prone to carrying personal effects such as wallets, cosmetics, address books, etc. in handbags and shoulder bags. Such bags come in a variety of shapes and sizes, typically including either a handle or shoulder strap. When a handle is employed, the bag must be carried, thereby occupying one hand of the user. In the case of shoulder straps, the bag typically hangs loosely in an awkward position under one arm. Also, because the weight of these bags must be borne by either one hand or one shoulder, the bag becomes a burden to carry if the weight of the articles therein exceeds a few pounds. Moreover, neither shoulder bags nor handbags provide adequate protection against "purse" snatchers.

It is accordingly an object of the present invention to provide a utility bag system to be worn on the person and which overcomes one or more of the above-noted deficiencies of handbags and shoulder bags.

It is a further object of the present invention to provide a utility bag system to be worn on the person and wherein the bags are secured to the body in a manner which facilitates carrying heavier articles.

It is yet a further object of the present invention to provide a utility bag system to be worn on the person and which leaves the wearer's hands and arms free for other uses.

It is still a further object of the present invention to provide a utility bag system to be worn on the person and which is relatively secure against "purse" snatching.

SUMMARY OF THE INVENTION

In accordance with the invention, I have developed a utility bag system to be worn by a person. In the broad sense, this system comprises a waist belt, a first bag defining a storage compartment and having a first means secured to the back thereof for receiving the belt, a second bag defining a storage compartment and having a second means secured to the back thereof for receiving the belt, and a strap secured at one end to the top of the first bag and at the other end to the top of the second bag, the strap being sufficiently long that the first and second belt receiving means confront the waist of the user when the strap is disposed about the neck, shoulder or waist, such that the belt may be received by the first and second belt receiving means for securing the bags close to the person, with the bags being slidable along the belt for adjusting the positions thereof.

The utility bag system of the present invention is capable of carrying a relatively large volume of articles while leaving the arms and hands free. Also, because it is supported, in large part, by the belt extending about the user's waist, i.e. the weight is supported largely by the hip bones, the bags are easy to carry, and should the weight distribution become uncomfortable, the bags may be shifted along the belt for redistributing the weight to different muscle groups for reducing fatigue.

Indeed, because the weight may be distributed between the two bags and is supported by the trunk of the body, the weight in the bags is much less burdensome than, for example, if the weight were carried in a single shoulder bag. In fact, the effect is so remarkable that the bags almost feel weightless. In this regard, it has been found that the bags are easiest to carry if they are positioned diagonally across the torso, with one bag in front and the other in back. Also, because of the manner in which the bags are secured to the user, i.e., by both the strap and the waist belt, the bags are relatively secure against "purse" snatching.

In a preferred embodiment, the backs of the bags are provided with pockets dimensioned to receive the hands of the user, which pockets may be lined, as with wool. Additional pockets may be provided on the front of the bags for storing small articles.

Further features and advantages of the utility bag system in accordance with the present invention will be more fully apparent from the following detailed description and annexed drawings of the presently preferred embodiment thereof.

DETAILED DESCRIPTION OF THE PREFERRED EMBODIMENT

Figure 1:
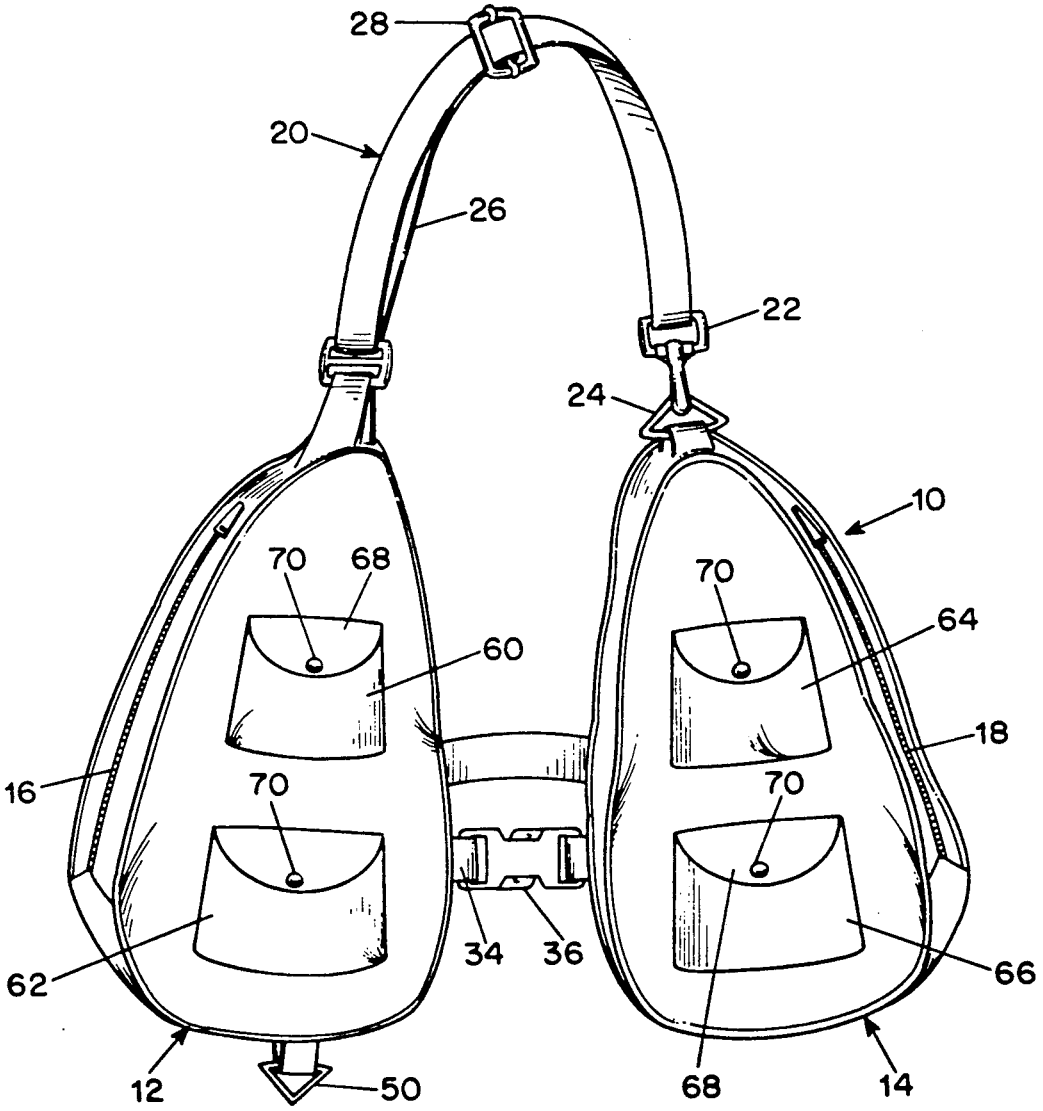
FIG. 1 is a front view of a utility bag system in accordance with the present invention.
Figure 2:
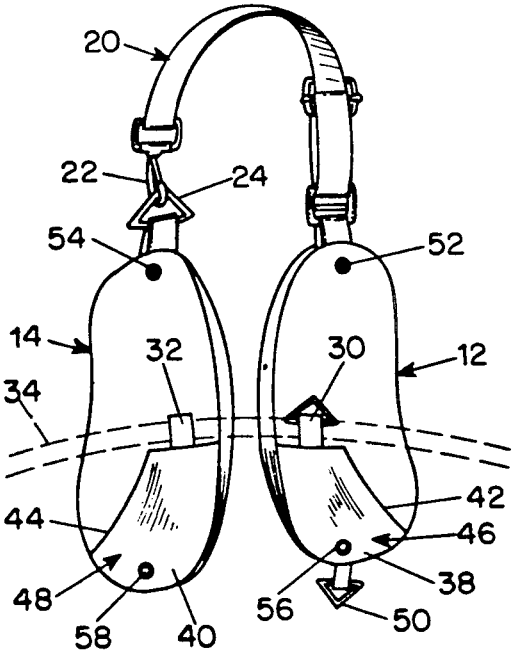
FIG. 2 is a rear view thereof.

Referring now to the drawings, and initially to FIGS. 1 and 2 thereof, the preferred utility bag system in accordance with the present invention is generally designated by the reference numeral 10. As shown, the system 10 includes a pair of bags 12, 14, each having an interior storage compartment accessed by zippers 16, 18, respectively. The bags 12, 14 may be comprised of cordura nylon, though any suitable material, such as leather, rubber, cloths, nylon, etc. may be used.

A strap 20 is fixedly secured, as by stitching, to the top of one of the bags 12. As shown, the free end of the strap 20 is provided with a releasable clip 22 for releasably securing the free end to a hook 24 provided for that purpose and fixedly secured to the top of the other bag 14. The hook 24 may, for example, be secured to a short strip of material stitched to the bag 14. As preferred and shown, the strap 20 includes a doubled section 26 fitted with a buckle 28 for adjusting the effective length of the strap 20. The strap 20 may comprise, for example, webbing. A hook 50, similar to the hook 24, is shown secured to the bottom of the bag 12, though it could be secured at other locations, e.g. the middle of the back of the bag 12. The hook 50 is secured to the bag 12 in the same manner as that employed for securing the hook 24 to the top of the bag 14. As more fully explained below, the hooks 24 and 50 are included so that, if desired, the free end of the strap 20 may be disengaged from the hook 24 on the bag 14 and attached to the hook 50 on the bag 12 for accommodating use of the bag 12 alone.

As shown, a plurality of small pockets 60, 62, 64, 66 may be sewn or otherwise secured to the front of the bags 12, 14 to provide additional compartments for carrying small articles. Preferably, each pocket 60, 62, 64, 66 is provided with a cover or flap 68 securable in a closed position by a snap 70. An additional piece of material 38, 40 is secured, as by stitching, to the back of each bag 12, 14 beneath the loops 30, 32, the edges 42, 44 being left unstitched for providing access to the pockets 46, 48 defined between the backs of the bags and the pieces of material 38, 40.

As best shown in FIG. 2, and for reasons that will be apparent below, a female snap portion 52, 54 is secured at the top of the back of each bag 12, 14, and a mating male portion 56, 58 is secured at the bottom of the back of each bag. Loops 30, 32 are also secured to the backs of the bags 12, 14, approximately mid-height thereof. The loops 30, 32, which may be secured by stitching, are sufficiently wide to receive a belt 34 having the usual buckle 36 for releasably securing the belt about the waist of the user. Preferably, the belt 34 comprises webbing, though as will be apparent below, any conventional belt that will fit through the loops 30, 32 may be employed. If desired, for additional support and/or accommodating different body lengths, two or more loops 30, 32 may be employed on each bag.

Figure 3:
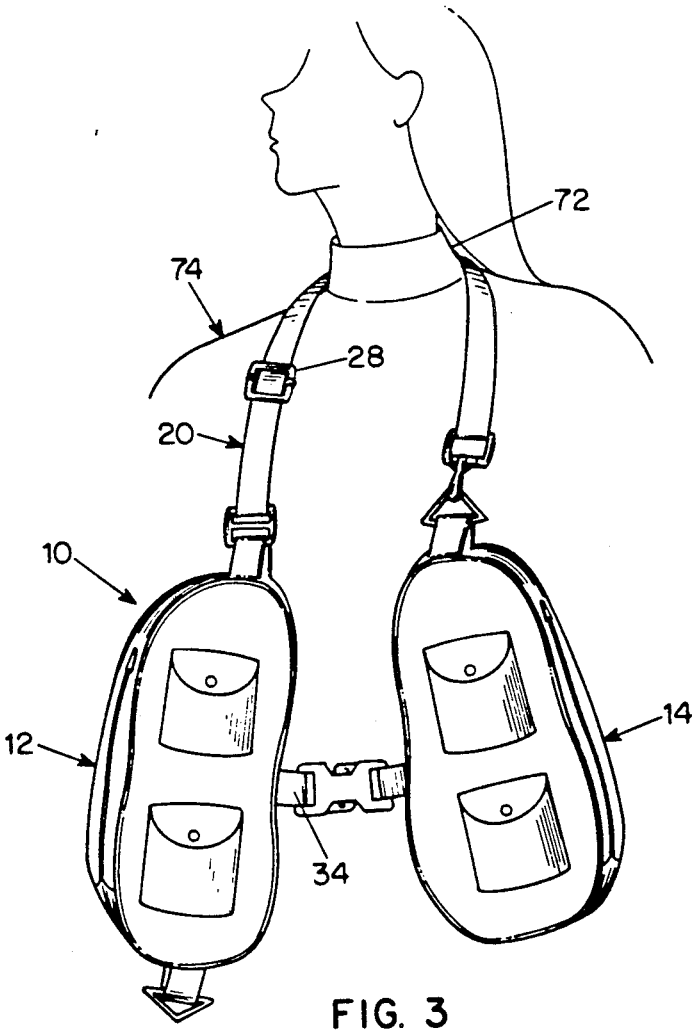
FIG. 3 is a perspective view showing the utility bag system in use with both bags on the front of the user.

Referring now to FIGS. 3–7, various modes of use of the utility bag system 10 in accordance with the present invention will now be described. Referring first to FIG. 3, the strap 20 is disposed about the neck 72 of the user 74, the length of the strap being adjusted via the buckle 28 until the loops 30, 32 are at waist level, the strap 20 being loose enough that the weight is supported by the hips, not by the neck and shoulders. Thereafter, the belt 34 is disposed about the waist and passed through the loops 30, 32 whereupon the belt buckle 36 is closed. In FIG. 3, both bags 12, 14 are disposed on the front of the user 74 where they do not interfere with the arms or hands. Additionally, in this position, all of the compartments of the bags 12, 14 are readily accessible via zippers 16, 18 and pockets flaps 68 and the weight in the bags 12, 14 is symmetrically distributed. By appropriately adjusting the length of the strap 20 via the buckle 28, the bags 12, 14 will be supported on the hips by the waist belt 34, which makes the bags easier to carry, especially when the contents are heavy. Of course, if desired, the strap 20 may be shortened such that the bags 12, 14 will be supported, at least in part, by the user's neck and back or, alternatively, the belt 34 may be removed altogether.

When the bags 12, 14 are in the position shown in FIG. 3, the pockets 46, 48 are adjacent to the body just below the waist. In this arrangement, they are perfectly positioned for the user to slip his/her hands into the pockets for comfort or for keeping them warm, much in the manner of a muffler. For this purpose, the insides of the pockets 46, 48 may be lined, as with wool, lamb's wool, fur, etc. Of course, small articles may be stored in these pockets.

From the foregoing it is apparent that the utility bag system 10 is versatile, comfortable to wear, provides a relatively large amount of carrying space, and is relatively safe from "purse" snatchers. Indeed, because the weight is distributed between the bags and supported by the trunk of the body, the bags almost feel weightless.

Figure 4:
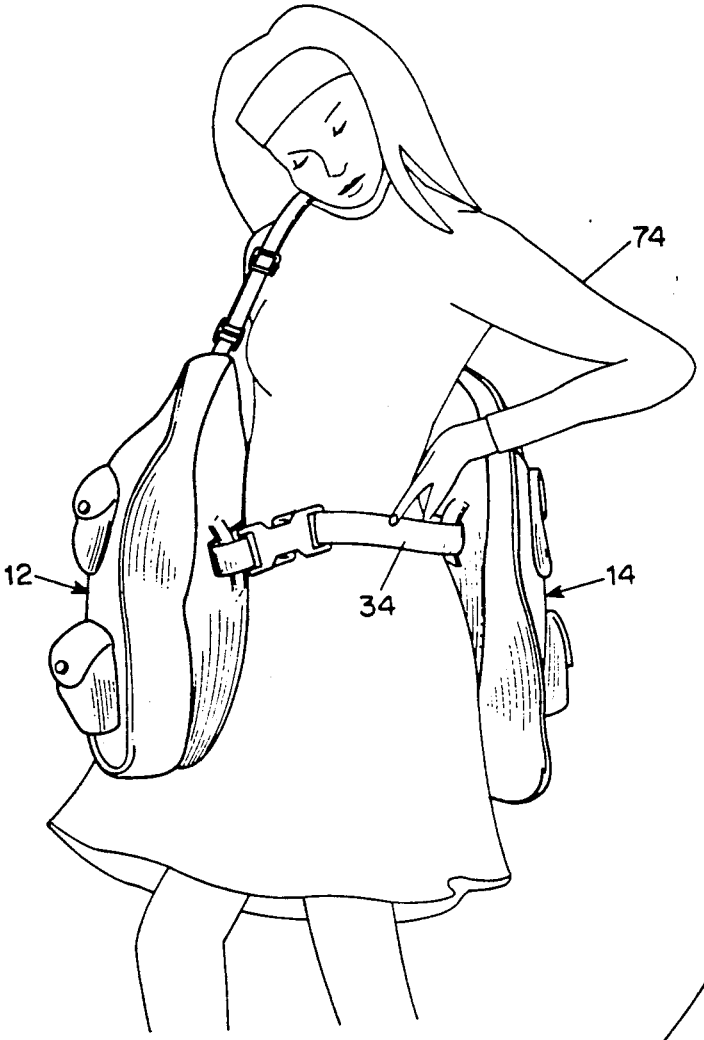
FIG. 4 is a view similar to FIG. 3, but showing the utility bag system arranged with one bag in front of the user and the other in back.

In FIG. 4, the bag 14 has been swung around to the back, such that it is diametrically opposed to the bag 12. Movement of the bag 14 from the position shown in FIG. 3 to the position of FIG. 4 may be accomplished by simply gripping the bag 14 and sliding it along the belt 34 while passing the left arm under the strap 20. Switching between the arrangements shown in FIGS. 3 and 4 allows the weight of the bags 12, 14 to be redistributed on the hips about the waist, and, in fact, the position shown in FIG. 4 has been found to be the most comfortable. Of course, instead of swinging the bag 14 around to the back of the user 74, the bag 14 may be kept in front and the bag 12 swung around to the back.

Figure 5:
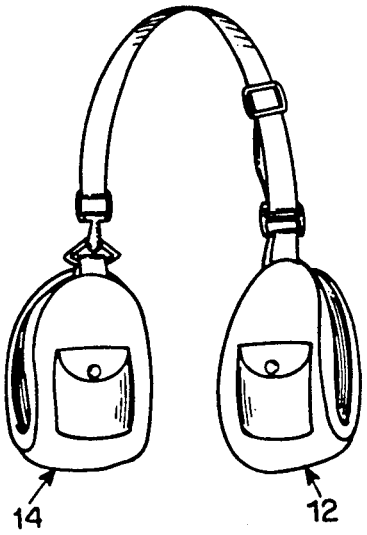
FIG 5 is a view similar to FIG. 3, but showing the bags folded in half.

In FIG. 5, each bag 12, 14 has been folded on itself and secured in that position by male snap portions 56, 58 mating female snap portions 52, 54. It will be apparent that in this arrangement, the loops 30, 32 are between the folded halves of the bags 12, 14. For this reason, and as preferred and shown in FIG. 2, the loops 30, 32 are just below the centers of the bags 12, 14, such that when the bags are folded in half, the loops remain vertical. As a result, and as shown in FIG. 5, the belt 34 may still be passed through the loops 30, 32 and about the waist for holding the bags 12, 14 closely adjacent the user. The arrangement of FIG. 5 is particularly suited for making the system 10 less bulky when the bags 12, 14 are not filled.

Figure 6:
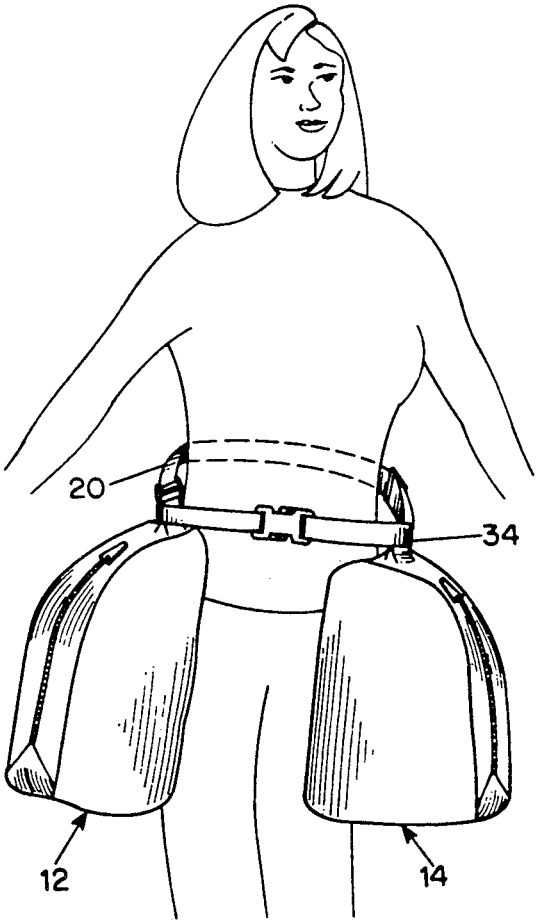
FIG. 6 is another view similar to FIG. 3, but showing an alternative arrangement of the utility bag system of the invention.

FIG. 6 shows yet an additional configuration for the utility bag system 10 of the invention. In FIG. 6, the length of the strap 20 has been adjusted such that it fits comfortably about the back of the waist, and the belt 34 is looped about the ends of the strap 20 for holding bags 12, 14 at waist level. Note that in FIG. 6 the belt 34 does not extend completely about the waist, but rather is "doubled up" and disposed adjacent the user's stomach region. When the system 10 is worn in the configuration shown in FIG. 6, the bags 12, 14 are preferably secured in their folded positions illustrated in FIG. 5 for confining the bags to the hip region. Alternatively, smaller bags may be substituted, whereupon the system 10 may be configured as shown in FIG. 6 without the necessity of folding the bags in half.

Figure 7:
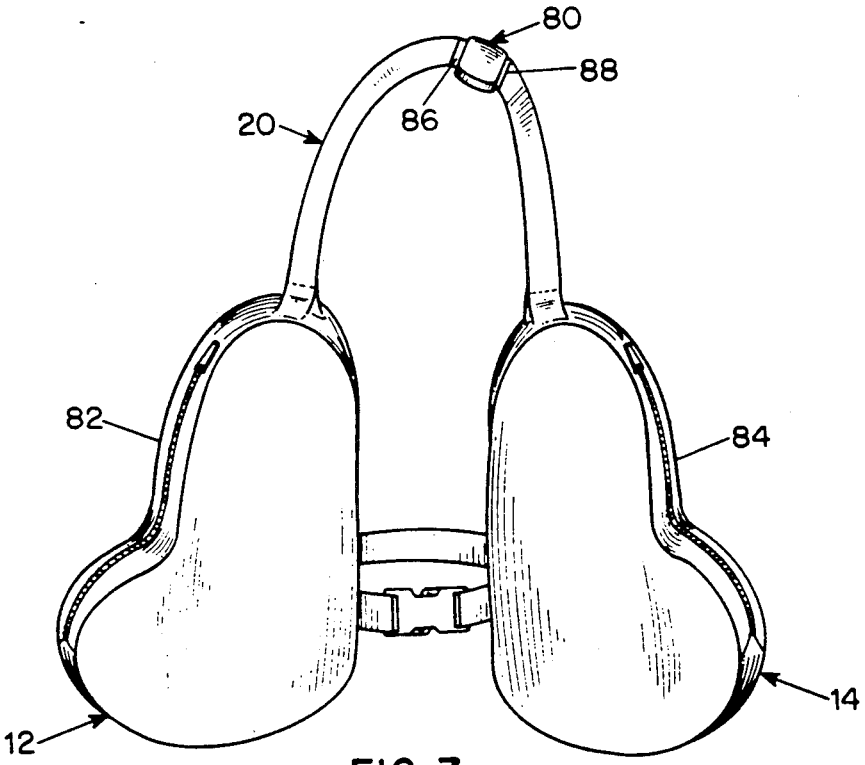
FIG. 7 is an alternative embodiment of the utility bag system particularly suited for use by bicyclists.

FIG. 7 illustrates a still further modification of the utility bag system 10 particularly suited for use by bicyclists. The embodiment of FIG. 7 utilizes a strap 20 having a clasp 80 which may comprise two disengageable clips, snaps or hooks 86, 88. Also, in FIG. 7 the bags 12, 14 are formed with a cutout or recessed portions 82, 84, respectively, dimensioned to fit under the user's arms.

Figure 8:
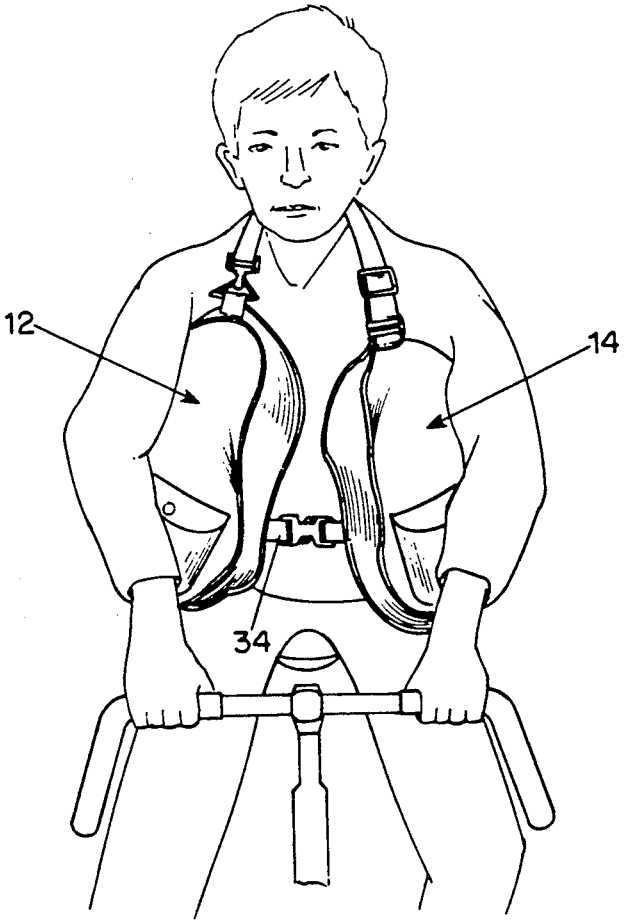
FIG. 8 is a front view showing the embodiment of FIG. 7 as worn by a cyclist.

As shown in FIG. 8, the embodiment is ideally suited for use by cyclists. When so used, the bags are preferably positioned over the chest with the recessed portions of the bags 12, 14 fitted under the user's arms and with the belt 34 extending about the waist. It will be appreciated that with the bags 12, 14 and belt 34 so positioned, the bags are held close to the user's chest where they do not interfere with the cyclist's leg movements. As preferred and shown in FIG. 9, when worn by a cyclist, the clips 86, 88 are preferably disengaged and the resulting two halves of the strap 20 lengthened via the buckles 28 and 78, such that the two halves of the strap may be criss-crossed on the user's back and reattached to the belt 34 via the clips 86, 88. The advantage of this arrangement is that it aids in keeping the bags 12, 14 close to the cyclist's body much more comfortably than by wearing the strap 20 tightly about the neck. Of course, when the clips 86, 88 are engaged and the length of strap 20 suitably adjusted via the buckles 28, 78, the embodiment of FIG. 7 may be worn in any of the various configurations described hereinabove for the embodiment of FIG. 1, of which, as noted, the configuration of FIG. 4 is most desirable.

Figure 9:
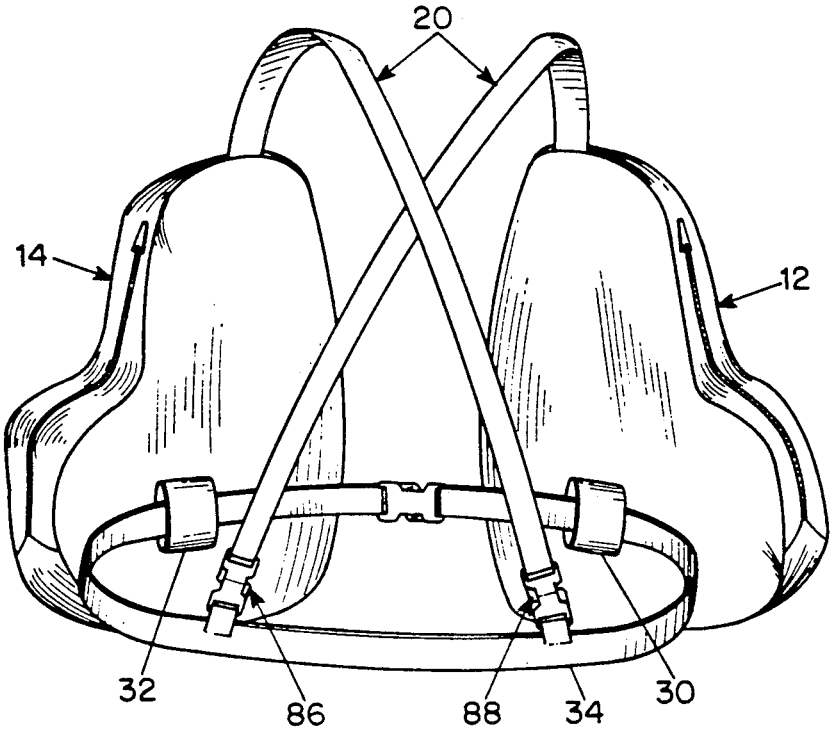
FIG. 9 is a back view of the embodiment if FIG. 7 in its configuration as worn by a cyclist.
Figure 10:
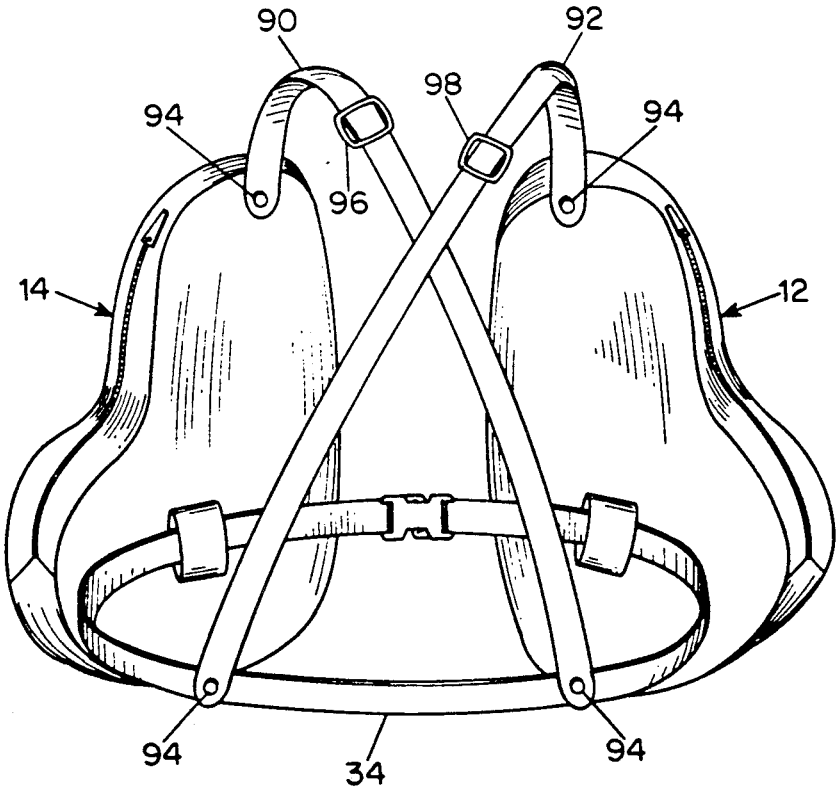
FIG. 10 is a back view of a yet further alternative embodiment particularly suited for use by cyclists.
Figure 11:
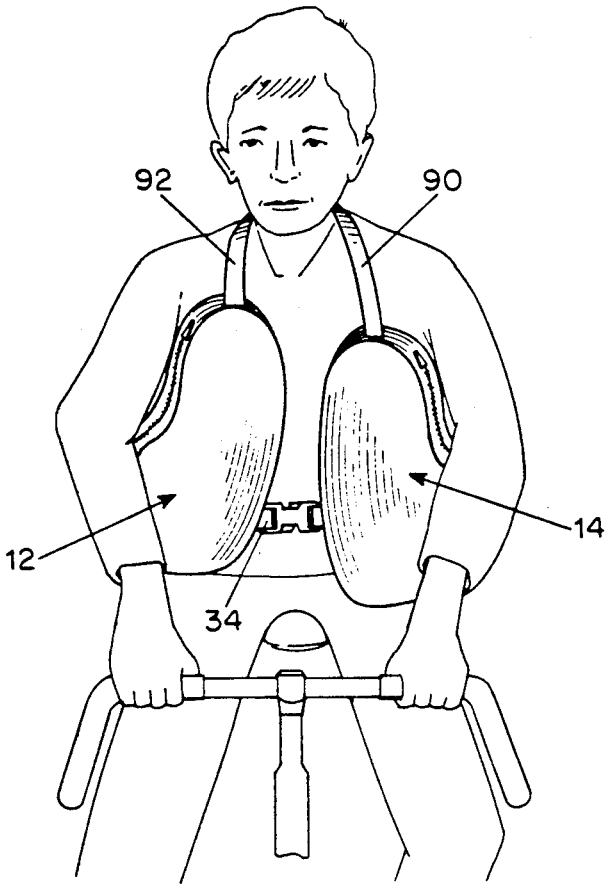
FIG. 11 is a front view of the embodiment of FIG. 10 as worn by a cyclist.

Yet another embodiment of the utility bag system 10 particularly suited for use by cyclists is illustrated in FIGS. 10–11. In FIGS. 10–11, and as best illustrated in FIG. 10, the usual strap 20 is replaced by two straps 90 and 92. The strap 90 is secured at one end to the top of bag 14 and at the other end to the back of belt 34. Similarly, the strap 92 is secured at one end to the top of bag 12 and at the other end to the back of belt 34 such that the straps 90, 92 criss-cross on the user's back which, as note above in connection with the embodiment of FIGS. 7–9, is preferable for holding the bags 12, 14 closely adjacent the cyclist's body. For this purpose, and as preferred and shown, the straps 90, 92 preferably include buckles 96, 98, respectively, for adjusting the lengths of the straps.

Figure 12:
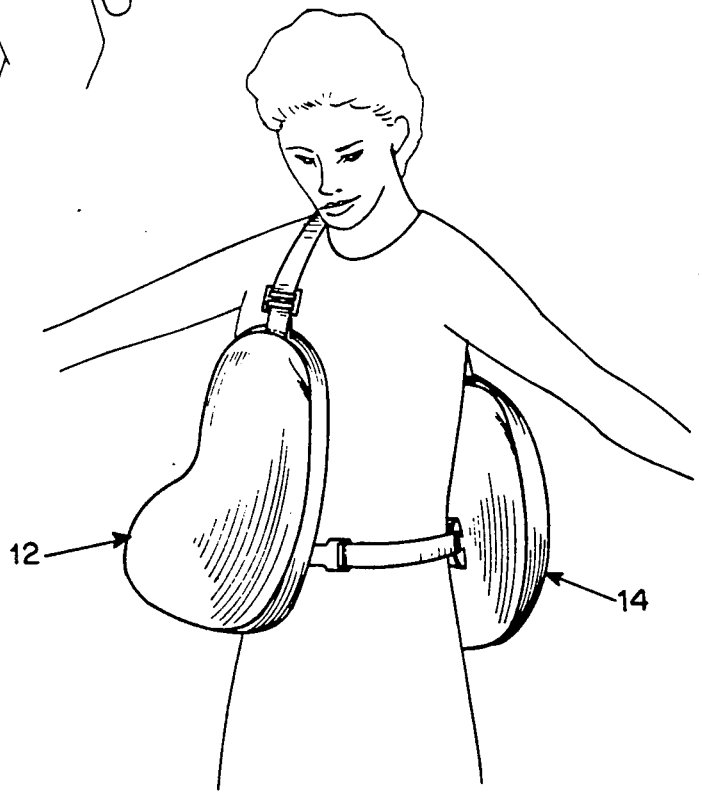
FIG. 12 is a perspective view showing the embodiment of FIGS. 10–11 for use in the configuration shown in FIG. 4.

The straps may be secured to the bags 12, 14 and belt 34 by snaps 94, though numerous other means of attachment will suggest themselves to those of ordinary skill in the art who have read this description. However, for reasons explained below, the attachment means is preferably a releasable attachment means, and presently snaps 94 are preferred. For use in the configurations described above in FIGS. 1–9, the strap 92 is removed, and the bottom of the strap 90 is unsnapped from the belt 34 and reattached to the top of the bag 12, whereupon the length of the strap 90 is adjusted as necessary via the buckle 96. As shown in FIG. 12, the embodiment of FIGS. 10–11 may then be worn, for example, in the configuration of FIG. 4. Of course, instead of removing the strap 92, the strap 90 could be removed and the bottom of strap 92 reattached to the top of the bag 14.

While I have herein shown and described the preferred embodiment of a utility bag system in accordance with the present invention and suggested certain modifications thereto, it will be apparent that still further changes and modifications may be made. For example, in any of the arrangements illustrated in FIGS. 3–7, the belt 34 may be dispensed with, and the strap 20 adjusted to various lengths. Also, if only a single shoulder bag is required, the clip 22 may be detached from the hook 24 and reattached to the hook 50 at the bottom of the bag 12 or to the belt loop 30, whereupon the bag 12 may be utilized separately as a shoulder bag, with or without the waist belt 34. Since these and still further changes and modifications may be made without departing from the spirit of the invention, the above description should be construed as illustrative, and not in a limiting sense, the scope of the invention being defined by the following claims.

I claim:

1. A utility bag system to be worn by a person in conjunction with a belt to be worn about the waist, said system comprising:

a first bag defining a storage compartment and having a first means secured thereto for slidably engaging said belt for axial movement relative thereto such that said first bag's position relative to said person's body may be changed by sliding said first bag axially along said belt;

a second bag defining a storage compartment and having a second means secured thereto for slidably engaging said belt for axial movement relative thereto such that said second bag's position relative to said person's body may be changed independently of said first bag by sliding said second bag axially along the belt; and a strap secured at one end to said first bag and at the other end to said second bag, said first and second belt engaging means confronting said person's body when said strap is disposed about said person's neck, shoulder or waist, said belt slidably engaging said first and second belt engaging means for securing said bags close to said person with each of said bags being independently slidable axially along said belt for independently adjusting the positions of said bags along said belt;

wherein no additional straps restrict independent movement of said first and second bags axially along said belt; and wherein said first and second belt engaging means are disposed intermediate of said first and second bags, respectively, such that a portion of each of said first and second bags extends below said belt for support thereby, such that part of the weight of said first and second bags is supported by said person's waist thereby reducing the amount of weight of said first and second bags supported by said person's neck and shoulders.

2. The utility bag system of claim 1, further comprising means for releasably securing said other end of said strap to said second bag, and means at the bottom of said first bag for attachment to said releasable securing means, whereby said other end of said strap may be optionally secured to the bottom of said first bag by joining said releasable securing means to said attachment means.

3. The utility bag system of claim 1, wherein said first and second bags each comprises a pocket on the back thereof dimensioned for receiving the hands of said person.

4. The utility bag system of claim 1, further comprising means for adjusting the length of said strap.

5. The utility bag system of claim 1, wherein said system further comprises said belt.

6. The utility bag system of claim 4, wherein said system further comprises said belt.

* * * * *